US008794721B2

(12) United States Patent
Pedersen

(10) Patent No.: US 8,794,721 B2
(45) Date of Patent: Aug. 5, 2014

(54) COVER FOR A STORAGE UNIT

(75) Inventor: Uffe P. E. Pedersen, Arhus N (DK)

(73) Assignee: Behr A/S (DK)

( * ) Notice: Subject to any disclaimer, the term of this patent is extended or adjusted under 35 U.S.C. 154(b) by 0 days.

(21) Appl. No.: 13/603,180

(22) Filed: Sep. 4, 2012

(65) Prior Publication Data

US 2012/0325820 A1 Dec. 27, 2012

Related U.S. Application Data

(63) Continuation of application No. PCT/DK2011/000010, filed on Feb. 23, 2011.

(30) Foreign Application Priority Data

Mar. 3, 2010 (DK) ..... 2010 00166

(51) Int. Cl.
*B65D 43/20* (2006.01)

(52) U.S. Cl.
USPC ..... 312/116; 312/138.1; 312/349

(58) Field of Classification Search
USPC ..... 312/116, 138.1, 139.1, 139.2, 323, 301, 312/349, 350, 287, 332; 220/592.02, 220/592.04, 592.09, 345.5, 507; 49/209; 62/248, 298, 246
See application file for complete search history.

(56) References Cited

U.S. PATENT DOCUMENTS 1,115,345 A 10/1914 Steuernagel
1,499,365 A * 7/1924 Gustus ..... 312/116
1,678,453 A * 7/1928 Welch ..... 312/139.1
1,845,385 A * 2/1932 Zelenka ..... 312/114
1,855,953 A 4/1932 Friedrich
1,963,089 A * 6/1934 Henderson ..... 312/296
2,269,631 A * 1/1942 Marinello ..... 105/377.09
2,420,879 A * 5/1947 Herter ..... 49/404

(Continued)

FOREIGN PATENT DOCUMENTS

DE 29517371 U1 12/1995
DE 202008006892 U1 8/2009

(Continued)

OTHER PUBLICATIONS

Danish Search Report; Application No. PA 2010 00166; Issued: Oct. 14, 2010; 1 page.

(Continued)

*Primary Examiner* — Janet M Wilkens
(74) *Attorney, Agent, or Firm* — St. Onge Steward Johnston & Reens LLC

(57) ABSTRACT

A cover for a merchandising storage unit for displaying of goods with a storage compartment, which cover includes at least one lid having a rear part and a front part, and which is displaceable towards an open position by displacing the lid away from an access side of the storage compartment, wherein the lid in a closed position is arranged at an angle in relation to horizontal, the cover having a rail system having at least a right rail arrangement and a left rail arrangement for guiding the at least one lid, wherein each rail arrangement includes a first track for guiding the front part of the lid and having a front part and a rear part, and a second track for guiding the rear part of the lid and having a front part, and a rear part, wherein the second track is separate to said first track.

18 Claims, 7 Drawing Sheets

(56) References Cited

U.S. PATENT DOCUMENTS

| | | | | | |
|---|---|---|---|---|---|
| 2,534,488 | A | * | 12/1950 | Weber | 62/246 |
| 2,652,305 | A | | 9/1953 | Swedman et al. | |
| 2,694,613 | A | * | 11/1954 | Williams | 312/138.1 |
| 2,793,925 | A | * | 5/1957 | Rosen | 312/139.2 |
| 2,994,572 | A | | 8/1961 | Morrison | |
| 3,269,787 | A | | 8/1966 | Harter | |
| 3,295,907 | A | | 1/1967 | Galvin | |
| 3,729,243 | A | | 4/1973 | Musgrave et al. | |
| 4,949,552 | A | | 8/1990 | Adams | |
| 4,949,554 | A | * | 8/1990 | Branz et al. | 62/248 |
| 4,962,865 | A | * | 10/1990 | Kakinuma et al. | 220/592.25 |
| 2005/0052099 | A1 | * | 3/2005 | Behr et al. | 312/139.2 |

FOREIGN PATENT DOCUMENTS

| | | | | |
|---|---|---|---|---|
| EP | 1391171 | A1 | | 2/2004 |
| GB | 398619 | A | | 9/1933 |
| JP | 54023249 | | * | 2/1979 |
| JP | 3045212 | A | | 2/1991 |

OTHER PUBLICATIONS

International Search Report; Application No. PCT/DK2011/000010; Issued: Sep. 26, 2011; Mailing Date: Oct. 4, 2011; 3 pages.

* cited by examiner

COVER FOR A STORAGE UNIT

CROSS-REFERENCE TO RELATED APPLICATIONS

The present application is a continuation of pending International patent application PCT/DK2011/000010 filed on Feb. 23, 2011 which designates the United States and claims priority from Danish patent application PA 2010 00 166 filed on Mar. 3, 2010, the content of which is incorporated herein by reference.

FIELD OF THE INVENTION

The invention relates to a cover for a merchandising storage unit, a method of retrofitting a cover and a merchandising storage unit.

BACKGROUND OF THE INVENTION

Covers for cooling furniture with a horizontal access opening in stores are well known in the art and have become more widespread in use for saving energy as they reduce the heat influx from the access opening and into the storage compartment of the cooled merchandising storage unit. In the resent years, cooling furniture covers which are displaced forwardly and horizontally away from the front side of the cooling furniture has become more popular because such covers facilitate that an increased number of customers can access the storage compartment of the cooling furniture at the same time, compared to covers which are displaceable sideways. Furthermore, it spares the customers since the customers may use their bodyweight to push and pull the covers to open and close these whereas covers which are displaceable sideways are more unhandy to operate.

EP 1 391 171 A1 discloses such cover for a cooling furniture. The cover includes at least two displaceable lids arranged in two rows along the long sides of the cooling furniture. The lids are displaceable mounted between two adjacent rails of the rail system, where the rails comprises separate tracks for the lids in each of the rows, so that the lids in the rows are displaceable in a direction perpendicular to the longer access sides of the rectangular cooling furniture. Furthermore, the cover has a stationary cover plate extending parallel to a long side of the cooling furniture.

U.S. Pat. No. 4,949,552 disclose a rounded lid for cooling furniture where the lid is displaceable upwardly in two rails by lifting and pushing the lid in a direction perpendicular to the long sides of the cooling furniture

SUMMARY OF THE INVENTION

A drawback of all the above-mentioned solutions is that the cover inevitably will impair the visibility of goods in the storage compartment.

It is an object of the present invention to provide an improvement of the known covers.

The invention relates to a cover for a merchandising storage unit for displaying of goods comprising a storage compartment, which cover comprises at least one lid having a rear part and a front part, and which is displaceable towards an open position by displacing the lid away from an access side of the storage compartment, wherein the lid in a closed position is arranged at an angle in relation to horizontal, the cover having a rail system having at least a right rail arrangement and a left rail arrangement for guiding the at least one lid, wherein each rail arrangement comprises:

a first track for guiding the front part of the lid and having a front part and a rear part, and a second track for guiding the rear part of the lid and having a front part, and a rear part, wherein said second track is separate to said first track.

It is advantageous to enhance the view to the goods in the storage compartment, through a cover of a merchandising storage unit. Furthermore it is due to aesthetic reasons a whish to give an impression of a continuous cover. However, lids guided by tracks along the sides of the lid give an impression of an uneven cover surface and reduces the view on the goods in the storage compartment. Furthermore, tracks supporting the sides of lids may be disadvantageous in relation to keeping an acceptable hygiene, and may thereby demand a more time consuming and frequent cleaning of the cover.

By utilizing separate tracks for guiding the front part and the back part of the lids respectively, it is possible to achieve a cover which will seem more like an open storage unit in that the lid is not supported by tracks underneath and along the sides of the lid. Instead, the front of the lid is guided by the first track whereas the rear of the lid is guided by the second track. This facilitates that the lid seems more as a frameless lid in that tracks supporting along the sides of the lids can be avoided.

The storage unit is preferably a cooling furniture but it may also be other types of storage units such as e.g. a display case for displaying other goods.

By the term front part of the lid and rear part of the lid is understood the foremost part and rearmost part of the lid. Preferably, the lid is connected to the tracks substantially at front and the rear corners of the lid but it may also be connected to the tracks at other locations at the rear/front part of the lid such as e.g. partly along the sides of the lid. For example, the front part of the lid may be connected to the first track at a location at the foremost third of the lid e.g. the foremost fourth of the lid such as the foremost fifth of the lid. Likewise, the rear part of the lid may be connected to the second track at a location at the rearmost third of the lid e.g. the rearmost fourth of the lid such as the rearmost fifth of the lid.

Likewise, with the term front part of the track is understood the parts of the tracks where the lid is supported when the lid is in a closed position.

Preferably, the front part of the second track is arranged above the first track so that the rear part of the lid at least in a closed position is elevated with a distance from the first track.

This is especially advantageous in that a track is not arranged along the sides of the lid. Instead, a gap is created between the rear of the lid and the first track. This gives an impression of a more frameless lid due to that the lid is only supported at the front part and the rear part of the lid.

In a preferred aspect of the invention, the lid at least in a closed position is arranged in an angle in relation to horizontal.

This facilitates that the customers may more easily get a good view at the goods in the storage compartment, especially due to the distance between the first track and the rear of the lid. Furthermore, it may prevent that people looking at the goods are not blinded by light reflected from the surface of the lid. Furthermore, condensed water at the outer side of the lid can run off the lid, thereby facilitating an enhanced view through the transparent lid, and that condensed water can be lead away from the lid.

Preferably, the front part of the lid is rotatably connected to the first track around a substantial horizontal axis, and the front part of the second track is arranged at a larger vertical distance from the first track than the rear part of the second track, so that the tracks are arranged with a mutual angle, and so that the lid will rotate around a horizontal axis when displaced from a closed position towards an open position.

Hereby, a space saving cover is achieved in that the rear part of the lid is displaced downwards to a lower position during opening of the lid, due to the mutual angle between the tracks. Furthermore it may facilitate an increased opening of the lid in that the lid for example may be displaced in under a stationary part of the storage unit. Likewise, this is advantageous when utilizing the cover in cooling furniture in that it may help to keep the glass above the cold air flow in the storage compartment, thus preventing cooling of the upper side of the lid and therefore reducing condensation when lid is returned to a closed position.

The lid is preferably arranged to be rotated around at least one horizontal axis, and may be rotated around two or even more horizontal axes dependent on the contact points between the lid and the tracks. As an example, the lid may be rotated around a horizontal axis located substantially at the front part of the lid, and the horizontal axis around which the lid is rotated may be displaced along with the displacement of the lid along the rail(s) and may vary dependent on the location of the lid on the track. Also, the lid may rotate around a horizontal axis located at the rear part of the lid during displacement. The lid is thus arranged to rotate appropriately to follow the path of the tracks of the rails.

In an aspect of the invention, the first track is arranged in a first rail, and the second track is arranged in a second rail.

This facilitates a cost effective solution due to that the tracks may be manufactured by means of substantially straight rails. In another aspect of the invention, the first and second track may be arranged in the same rail, e.g. by bending a rail and e.g. introducing a hole in track at the rear part of rail so that the rear part of the lid can be released from the second rail during opening of the lid.

It generally is understood that the tracks of the rail arrangements preferably are straight rails, but one or more of the rails may also be curved rails. For example, the second rail may be a curved rail arranged with a mutual angle to the first track as explained above.

Preferably, the rear part of the rail arrangements is attached to and hangs from an upper stationary part of the storage unit when the cover is installed at the storage unit.

This is advantageous in that the rail system is not supported on the bottom of the storage compartment. Thereby more space for goods is achieved and the installation of the cover in the storage unit may be more advantageous. Furthermore, in relation to cooling furniture it is advantageous that the rail arrangements hangs from warm parts such as the upper stationary part, since this may prevent cold from running from cold areas to warm. It is understood that the cover may comprise an upper stationary part to which the rail arrangement is attached, and that the upper stationary part may be considered as a part of the storage unit when the cover is implemented on the storage unit.

In an aspect of the invention, the rear part of the lid during an opening of the lid is configured to be released from the rear part of the second track, and is during closing of the lid configured to connect to and be guided by the second track when it reaches the second track.

This is advantageous e.g. in that material may be spared to achieve a more cost effective cover, and in that a lighter rail arrangement is achieved. Furthermore, it may facilitate a more easy installation of the cover and service on the cover may be achieved.

In an aspect of the invention, the rear of the rail arrangements does not extend all the way to the rear of the storage compartment, but ends somewhere before the rear of the compartment. For example, the rail arrangement may end before the rearmost fifth e.g. before the rearmost fourth, such as before the rearmost third of the storage compartment. Thereby, the installation of the cover may be even easier and more advantageous.

Furthermore, in relation to cooling furniture it is advantageous that the rail arrangement(s) are arranged at warmer areas of the compartment, and are kept out of colder airflow in the compartment to prevent disturbance of airflow in the storage compartment.

Preferably, the rear part of the lid comprises an upper contact part arranged above the upper surface of the lid which is arranged to connect the lid to the second track.

Hereby an advantageous way of catching the second rail during closing of the lid can be achieved. The contact part is preferably arranged substantially at the corner of the lid but it may also be arranged at another location at the rear of the lid.

In an aspect of the invention, the front part of the lid comprises a lower contact part, and the lower contact part is configured to support on a third track with a contact surface below and opposite to the first track, thereby preventing pivoting of the lid when the lid has been released from the second track and/or preventing users from disassembling the cover.

Hereby an advantageous and cost effective way of preventing unintentional pivoting of the lid when released from the second track may be achieved. Furthermore, it may as mentioned also prevent customers from disassembling the cover, in that the front of the lid cannot be lifted of the track. It is of cause understood that lower contact part is not limited to aspects of the invention where the rear part of the lid is released from the second track, but may be utilized in any suitable aspect of the invention, e.g. as mentioned for prevention of disassembling of the lid.

In a preferred aspect of the invention, the cover comprises at least two right rail arrangements and two left rail arrangements, to facilitate independent guidance of at least two lids arranged next to each other, where at least one of said right rail arrangements and at least one of said left rail arrangements are arranged together at one rail arrangement for guiding the two lids.

Hereby, the lids may be arranged closer together. However, in other aspects of the invention, a right and a left rail arrangement which are arranged next to each other to guide each their lids. It is understood that the cover may comprise any suitable number of lids arranged next to each other, e.g. between two and ten lids such as four, six or eight lids or even more lids such as twelve lids arranged next to each other.

Preferably, the rail arrangement comprising a right rail arrangements and a left rail arrangement comprises two second tracks with vertical displaced guiding paths arranged above each other for guiding the rear of the two lids when the lids are partly displaced towards the open position.

These vertical displaced guiding paths facilitates that the rear part of a first lid in an open position is arranged vertically displaced in relation to the rear part of another open lid next to the first lid. In embodiments where the rear part of the lid(s) are no longer supported by the second tracks (i.e. are released from the second track), the lid may advantageously be guided by lid guiding surfaces arranged at the rear of the rail arrangements. It is understood that the vertically displaced guiding paths may be utilized both in embodiments of the invention wherein the rear part of the lid is released from the second tracks as well as in embodiments where the rear part of the lid is not released from the second track during opening.

By the term "vertically displaced guiding paths" is understood that it is the guiding paths and/or lid guiding surfaces that are vertically displaced in relation to each other, above each other. It is understood that the vertically displaced guiding paths may be arranged directly above each other as well as partly above each other so that the guiding paths are at least partly horizontally displaced in relation to each other perpendicular to the guiding direction of the guiding paths.

The rail arrangement with vertically displaced guiding paths describes an S-form which facilitates that more material may be utilized for supporting/holding the rails comprising the tracks, without compromising the distance between the lids. This facilitates that the rail arrangements can be arranged closer to each other when hanging from and supported by an upper part of the storage unit.

In a preferred aspect of the invention, the rear part of the lid(s) are configured to hang from the second track by means of an upper contact part, and the sides of the lid extends over the outer end/side of the upper contact part, so that the side of the lid extend in under the rail comprising the second track. This facilitates that the lids may be arranged close together, thereby giving the experience of a more continuous surface of lids of the cover. This is especially advantageous in aspects of the invention where the lid(s) are rotated around a horizontal axis.

It is of cause understood that the upper contact part may be of any suitable size and layout.

Preferably, the horizontal distance between the sides of the lids arranged next to each other is less than 10 mm, preferably less than 5 mm such as less than 2 mm.

For example, the horizontal distance between the sides of the lids arranged next to each other may be 1 mm or even less. E.g. lids of a cover of a cooling furniture often comprise sealing means at the sides of the lids to avoid leaking of cold air from the storage compartment and/or to avoid dust and other particles to get into the storage compartment. It is however preferred to avoid such sealing means on the lids to achieve a cover which seems more continuous. This can be achieved by reducing the size of the sealing means or preferably avoid sealing means on the sides of the lids. The close arranging of the lids facilitates that such sealing means can be avoided or at least significantly reduced in size without increasing leaking of cold air between the lids, and/or increasing the amount of dust or other foreign objects to enter into the storage compartment.

In an aspect of the invention, the cover comprises two rail system rows with oppositely directed opening directions, wherein the rear part of lids arranged opposite to each other are configured to be vertically displaced in relation to each other during opening so that access to the storage compartment by means of the oppositely arranged lids is possible independently from each access side.

Hereby an advantageous cover is achieved for a larger storage unit, which facilitates access to the storage compartment at a plurality of areas along the access sides at the same time, and each lid may thus be opened independently of the position of other lids of the cover.

In a preferred aspect of the cover comprising two rail system rows, the rear part of the lids are vertically displaced by means of vertically displaced guiding paths of the second tracks for guiding the rear part of the lids during an opening of the lid.

Hereby an advantageous way of displacing the rear of the lids is achieved. Furthermore, it is advantageous in that the lids arranged side by side at the same time may be arranged closer to each other.

The invention also relates to a method of retrofitting a cover as described above on a merchandising storage unit for display of goods comprising a storage compartment, said method comprising attaching a front support of the cover to a front side of the storage unit, and attaching a rear part of the cover to an upper stationary part of the storage unit.

This is advantageous in relation to implementation in existing storage compartments. It is however of cause understood that the cover may also be implemented during manufacturing of the storage unit.

Furthermore, the invention also relates to a merchandising storage unit comprising a lower storage compartment and an upper stationary part, wherein the storage unit comprises a cover as described above, and wherein the lid(s) of the cover is displaced to a position underneath the upper stationary part during an opening of a lid(s).

Hereby, the height of the merchandising storage unit may be reduced so that customers may easier reach goods placed on the upper stationary part In an aspect of the invention regarding the above mentioned merchandising storage unit, the upper stationary part comprises an upper storage compartment.

Hereby, the lower part of the upper storage compartment may be arranged lower due to that the lids are displaced to a position underneath the upper storage compartment, thereby facilitating that a larger upper storage compartment can be utilized without compromising the accessibility to the uppermost part of the lower storage compartment. In other aspects of the invention, the merchandising storage unit does not comprise an upper storage compartment.

Likewise, the invention relates to a merchandising storage unit having a rectangular storage compartment and a cover as described above.

Furthermore, the invention relates to a cover for a merchandising storage unit for displaying of goods comprising a storage compartment, which cover comprises at least two lids having a rear part and a front part, and which are displaceable towards an open position by displacing the lid away from an access side of the storage compartment, the cover having a rail system having at least a right rail arrangement and a left rail arrangement for guiding each lid, wherein each rail arrangement comprises:

a first track for guiding the front part of a lid and having a front part and a rear part, and a second track for guiding the rear part of a lid and having a front part, and a rear part, wherein at least the rear part of lids arranged opposite to each other is configured to be vertically displaced in relation each other during opening so that access to the storage compartment by means of the oppositely arranged lids is facilitated independently from each access side.

BRIEF DESCRIPTION OF THE DRAWINGS

The invention will be described in the following with reference to the figures in which.

DETAILED DESCRIPTION OF THE INVENTION

Figure 1:
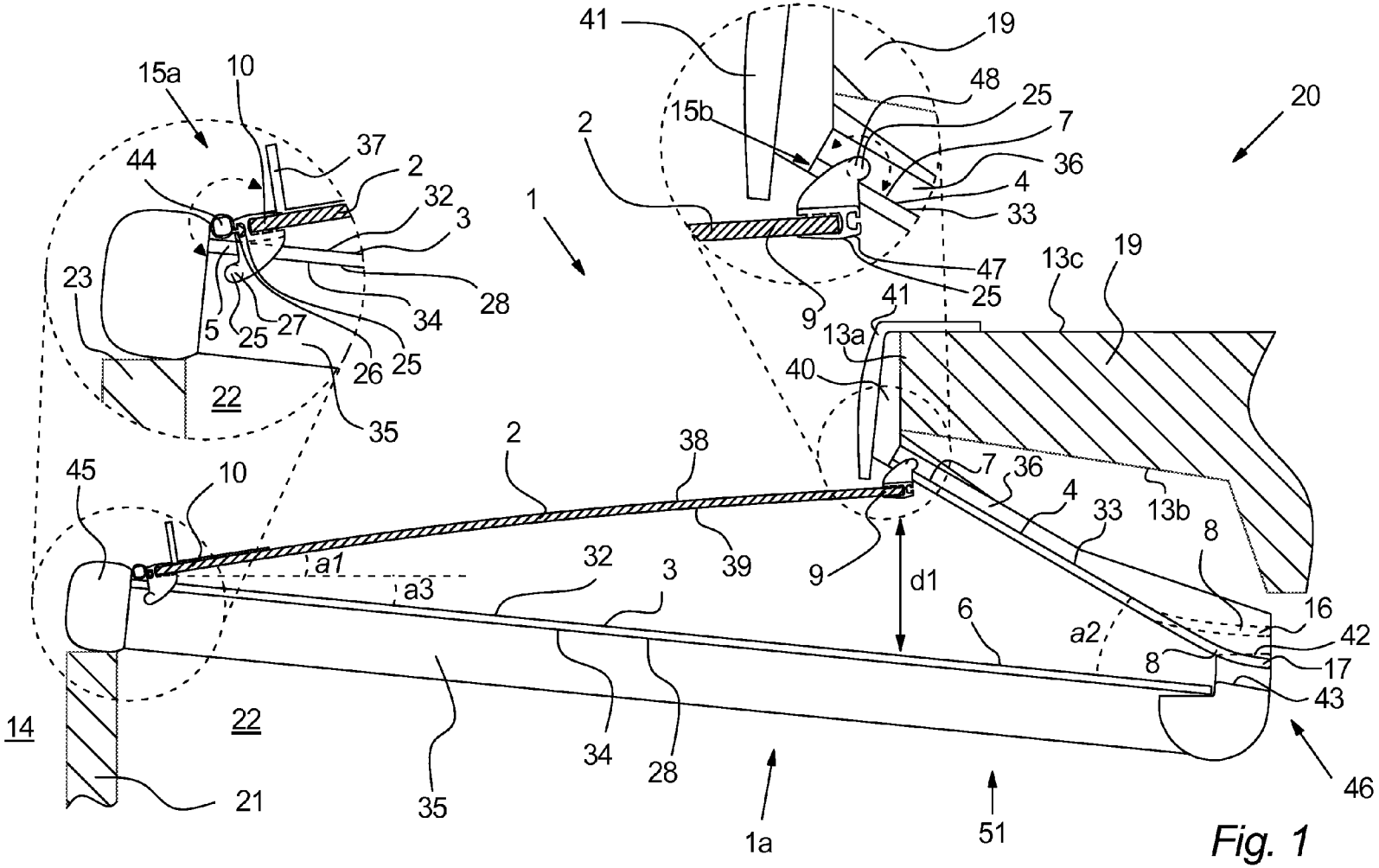
FIG. 1 illustrates a preferred embodiment of a rail arrangement of the rail system according to the invention seen from the side.

FIG. 1 illustrates a rail arrangement of a cover 1 for a merchandising storage unit 20 for display of goods in the storage compartment 22 of the storage unit 20. The storage compartment 22 may e.g. be quadratic or rectangular, and it is generally understood that the storage compartment 22 may comprise one or more compartments divided by means of e.g. walls. The storage unit 20 is preferably a cooling furniture such as a freezer or a refrigerator for freezing and/or cooling down e.g. foodstuffs stored in the storage unit 20. However, the storage unit 20 may also be other types of storage units such as e.g. a display case for displaying other goods such e.g. as jewelry, antiques or any other effects. The storage unit 20 preferably comprises a storage compartment 22 which is accessible through the horizontal plane, e.g. as the storage compartment of a chest refrigerator or chest freezer.

The cover 1 comprises a lid 2 and a rail system comprising a right rail arrangement 1*a* and a left rail arrangement 1*b* each guiding the rear part 9 and the front part 10 of the lid 2, preferably at the sides 31*a*, 31*b* of the lid 2. In FIG. 1 only one rail arrangement is shown to reduce complexity of the drawing. Each rail arrangement of the rail system comprises a first track 3 having a contact surface 32 for guiding the front part 10 of the lid 2, and a second track 4 having a contact surface 33 for guiding rear part 9 of the lid 2, where the tracks 3, 4 are separate to each other. The lid 2 is guided by the tracks 3, 4, by means of contact parts 25 which connect the lid 2 to the tracks 3, 4 of the rail arrangements. In the present example, the contact parts 25 are a part of connection parts 15*a*, 15*b*.

The lid 2 is as illustrated preferably guided substantially at the front and rear corners of the lid 2, but may also be guided at other locations at the front part and rear part of the lid.

The lid 2 may be a flat/plane lid 2 it may be a curved lid or the like. Furthermore, the lid 2 is preferably at least partly transparent to light so that costumers can see the content of the storage 22 through the lid 2. Furthermore, the lid 2 may comprise different means for prevention of dew formations on the surface of the pane. An example hereof may be a transparent infrared and/or electric heated layer (not illustrated) that facilitates heating of a surface of the lid 2. This may become especially advantageous in relation to embodiments where the cover 1 is installed in a cooling furniture 20, and/or if the storage unit 20 is located in cold surroundings.

As illustrated in FIG. 1, the front part 7 of the second track 4 is arranged at a larger vertical distance from the first track 3 than the rear part 8 of the second track 4, above the first track 3, thereby creating a mutual angle a2 between the tracks 3, 4, so that the front part 7 ends with a distance above the first track 3.

This facilitates that the rear part 9 of the lid 2 in a closed position is arranged with a distance dl between the rear part 9 of the lid 2 and the first track 3, with an angle a1 in relation to horizontal. When opening the lid 2, the rear part 9 of the lid 2 is displaced towards a lower position due to the mutual angle a2 between the first track 3 and second track 4, thereby altering the angle a1 of the lid 2.

As further illustrated, the lid 2 is in a closed position elevated above the first track 3 so that the lid 2 is not supported along the sides 31*a*, 31*b* of the lid 2.

The angle a1 of the lid 2 facilitates that reflection of light in the surface 38 of the lid 2, which may blind customers looking at the goods in the storage 22, can be reduced or even avoided. Furthermore, the angle a1 may facilitate that condensed water on the lid 2 can run off the lid 2, thereby avoiding that condense water may drip onto the content/goods in the storage 22, and that it is easier and more comfortable to see the goods through the lids 2. Furthermore, the displacement of the rear part 9 of the lid 2 to a lower position during opening of the lid 2 is an advantageous space saving solution.

However, in other embodiments of the invention, the rear part 9 of the lids 2 may be displaced substantially parallel to and above the first track 3 (not illustrated in any figures), substantially without displacing the lid(s) to a lower position. This may e.g. be achieved by arranging the second track 4 substantially parallel to the first track 3.

The angle a1 in relation to horizontal may be at least 3° such as at least 7°, e.g. 15°.

In general, it is understood that lid(s) 2 of the cover 1 may be opened and closed by displacing the lid(s) 2 away from a side, preferably an access side 14 of the storage compartment 22, and may be closed by moving the lid towards an access side 14 of the storage compartment 22. This is also illustrated in FIGS. 4-10.

In an embodiment of the invention, the lid(s) 2 of the cover 1 may be opened and closed by displacing the lid(s) 2 away from and substantially perpendicular to the access side 14 of the storage compartment 22.

Preferably, the front part 7 of the second track 4 ends above the rearmost half of the first track 3, such as above the rearmost third of the first track 3. However, it is understood that the front part 7 of the second track 4 in other embodiments may end anywhere above the first track 3, e.g. dependent of the length of the lid 2 and/or the angle a1 of the lid.

The lid 2 is rotatably connected to the tracks 3, 4 so that the front part 10 and the rear part 9 of the lid 2 may rotate around a horizontal axis during the displacement of the lid 2, especially in the embodiment where the tracks 3, 4 are arranged with a mutual angle a2.

As disclosed in the present document, the lid 2 may rotate around a first horizontal axis located near the front part of the lid 2 and a second horizontal axis located near the rear part of the lid. The first and/or second horizontal axis may be located substantially at or near contact points at the front and the rear of the lid 2 where the lid 2 is in contact with tracks 3, 4.

If the lid 2 is configured to be released from a second track during opening of the lid as explained in more details later on in relation to e.g. FIG. 7, a rotation around a first horizontal axis located at the front part of the lid, and a horizontal axis located where the lid is supported by a lower lid-guiding surface. The rotation may in this embodiment be determined by the curvature of the lid 2.

As mentioned above, the lid 2 is preferably guided on the tracks 3, 4 by means of connection parts 15*a*, 15*b*, comprising at least a front connection part 15*a*, and a rear connection part 15*b*. Each of these connection parts 15*a*, 15*b* comprises at least one contact part 25 facilitating contact between the tracks of a rail 3, 4, 28, and the lid. The contact part(s) 25 may comprise a surface which may slide over the tracks 3, 4, preferably comprising a contact surface with low friction. This may e.g. be achieved by means of material such as polytetrafluoroethylene (PTFE), Poly Vinyl Chloride (PVC), a silicone material, other plastic materials and/or any other type of suitable material.

A preferred material for the rail arrangement is Poly Vinyl Chloride (PVC), but it is of cause understood that other material such as a silicone material, and/or any other materials such as other suitable plastic materials may be utilized.

It is also understood that also a material such as metal, wood, glass or the like may be relevant in some embodiments of the invention. The contact part(s) 25, may also or instead comprise wheels (not illustrated) rolling on the track(s), or any other suitable means. The contact parts 25 of the connection parts 15*a*, 15*b* are arranged substantially at each side (31*a*, 31*b*) at the front part 10 of the lid 2 and the rear part 9 of the lid 2.

The contact parts 25 of the connection parts 15*a*, 15*b* may comprise comprises one or more contact parts 26, 27, 47, 48 which connects the lid 2 to the tracks 3, 4. For example, the front connection part 15*a* may comprise an upper contact part 26 facilitating a contact with the first track 3, and a lower contact part 27 facilitating contact with a third track 28. The third track 28 is explained in more details later on.

Furthermore, the rear connection part 15*b* may comprise a lower contact part 47 and an upper contact part 48, where the upper contact part 48 facilitates contact with the second track 4 and the lower contact part facilitates contact with a lid guiding surface 42, 43. However, it is understood that in other embodiments of the invention, for example the lower contact part 47 of the rear connection part 15*b* and the upper contact part 26 of the front connection part 15*a* may be spared, so that the front part 10 of the lid 2 may get in direct contact with the track 3, and the rear part 9 of the lid 2 may get in direct contact with the lid guiding surface 42, 43 and/or the first track 3.

The rear part of the rail arrangement does in a preferred embodiment of the invention (but not in any way limited thereto) not extend to the rearmost back of the storage compartment 22. Instead, the rear part of the rail arrangement(s) ends before the rearmost fifth e.g. before the rearmost fourth, such as before the rearmost third of the storage compartment 22. In this embodiment, the rear part 9 of the lid 2 is released from the rear part of the track 4, and is guided by the first track 3 and a lid guiding surface 42 or 43.

The rail arrangement 1*a*, 1*b* may advantageously in such an embodiment comprise a third track 28 arranged substantially parallel to and bellow the first track 3, where the third track 28 has a contact surface 34 arranged opposite to the contact surface 32 of the first track 3. This is advantageous in that when the rear part 9 of the lid 2 during an opening of the lid 2 is released from the second track 4 to facilitate further opening of the lid, it may cause an unintentional pivoting of the lid 2. The reason for this is that the force acting on the front part 10 of the lid 2 alters from a downwardly directed force so that the front 10 supports on the first track 3, to an upwardly directed force during an opening of the lid 2, caused by the weight of the rear part 9 of the lid 2 released from the second track 4. To prevent an unintentional pivoting of the lid 2, the front connection part 15*a* may comprise the earlier mentioned lower contact part 27 facilitating contact with the contact surface 34 of the third track 28. Thereby, the front part 10 of the lid 2 supports on the first track 3 during a first part of the opening of the lid 2 by means of the upper contact part 26 of the front connection part 15, and supports on the third track 34 during a second part of the opening of the lid 2, by means of the lower contact part 27, after the rear part 9 of the lid 2 is released from the second track 4.

It is understood that the contact parts 25 in some embodiments of the invention may comprise flexible means (not illustrated) such as spring means for facilitating a more smooth transition when the rear of the lid 2 is released from the second track 4. Furthermore, the lid 2 may comprise one or more flexible protection lists 44 of e.g. a rubber material at for example the front of the lid 2. The list 44 may be arranged in the front connection part 15*a*, to protect the lid 2 and/or storage unit 20 during opening and closing of the lid 2 and/or to achieve a more airtight connection when the lid is in a closed position.

The rear part 46 of the rail arrangement 1*a*, 1*b* is preferably connected to and hanging from an upper stationary part 19 of the storage unit 20 which is arranged above the rear part of the storage compartment 22, without supporting on the bottom of the storage compartment. The upper stationary part 19 extends in over the rear of the compartment 22, such as in over the rearmost third of the compartment 22. Preferably, the rear part of the rail system 1*a*, 1*b* is fastened to the front 13*a* of the upper stationary part 19 of the storage unit 20 as illustrated, but it may also or instead be connected to other parts of the upper stationary part 19, for example a lower part 13*b* and/or upper 13*c* part of the upper stationary part 19. The connection to the upper stationary part 19 may be achieved by means of one or more screws, adhesives, rails parallel to the length of the storage unit 20, latch/notch connection(s) or any other suitable fastening means or combinations thereof facilitating fastening of the rear part of the rail arrangement to the upper stationary part 19.

In the present example, the rear part 9 of the lid 2 is in a closed position arranged substantially at the lower part of the front 13*a* of the upper stationary part 19 of the storage unit 20.

As illustrated, the front part of the rail arrangement is supported by the uppermost part 23 of the front side 14 of the storage unit 2. In the present example, the cover 1 comprises a front support 45 which supports on the uppermost part 23 of the front side 21 of the storage unit 20, but it may also be connected to the front side 21 of the storage unit 20 by means of fastening means such as screws, latch/notch or any other suitable means.

The first rail 3 is in the present embodiment arranged with an angle a3 in relation to horizontal. This angle a3 may vary dependent of the type of storage unit 20, so that the first track 3 is arranged underneath the upper stationary part 19, thereby allowing the lid 2 to be guided by the first track 3 to a position underneath the upper stationary part.

It is understood that the cover 2 may as illustrated and explained in more detail later on comprise two or more lids 2 arranged next to each other, to facilitate access to different parts of the storage compartment 22 and/or to different storage compartments 22 of the storage unit 20. In such cases, it is advantageous to arrange the sides 31*a*, 31*b* of the lids 2 close to each other. This is e.g. advantageous to avoid unnecessary escape of air from the storage 22, especially in embodiments of the invention where the storage unit 20 is a cooling furniture.

To achieve that the lids 2 are arranged close to each other and is still independently operateable, it is advantageous if the rear part 9 of lids 2 arranged next to each other are vertically displaced in relation to each other during an opening of the lids 2. Such a displacement of the rear parts 9 facilitates that more material can be utilized for carrying the weight of the lids, the weight of the rail(s) comprising the first and/or third track 28, weight of customers leaning onto the lid(s) 2, and the like. Furthermore it is avoided that that the rear of the lids/cover are supported by the bottom of the storage compartment 22.

The vertical displacement of the lids 2 is preferably achieved by means of at least one rail arrangement 51 comprising both a right rail arrangement 1*a* and a left rail arrangement 1*b* for guiding each their lids 2. One of the rail arrangements 1*a*, 1*b* comprises an upper vertical displaced guiding path 16 at the rear part of the second track 4 for guiding a first lid 2, and the other rail arrangement 1*a*, 1*b* comprises a lower vertical displaced guiding path 17 at the rear part of the second track 4 for a second lid arranged next to the first lid. The vertical displaced guiding paths 16, 17 are preferably arranged at the rear part 46 of the rail arrangement 1*a*, 1*b*. Thereby, when opening a lid 2 of the cover 1, the rear part 9 of the lid 2 is guided by the second track 4 to the vertical displaced guiding path 16, 17 of the second track 4.

The rail arrangement with the upper vertical displaced guiding path 16 preferably (but not limited thereto) comprises an upper lid-guiding surface 42 for supporting the lid 2 when it is released from the upper guiding path 16. Furthermore, the rail arrangement with the lower vertical displaced guiding path 17 preferably comprises a lower lid-guiding surface 43 for supporting the lid 2 when it is released by the lower guiding path 17.

The upper contact part 48 of the rear connection part 15*b* is elevated above the upper surface 38 of the lid 2. Furthermore, the vertical distance between the upper contact part 48 and the lower surface 39 of the of the lid 2 is preferably larger than the vertical distance between the lid guiding surface 42, 43 and the contact surface 33 at the rear part of the second track 4. Thereby, when the rear 9 of the lid 2 gets in contact with a lid guiding surface 42, 43 during an opening of the lid 2, the upper contact part 48 is released from the second track 4 and is displaced upwards. This facilitates that the upper contact parts 48 can grab the second track 4 automatically when closing the lid 2 in embodiments where the rear of the lid 2 is released from the second track 4.

Figure 2:
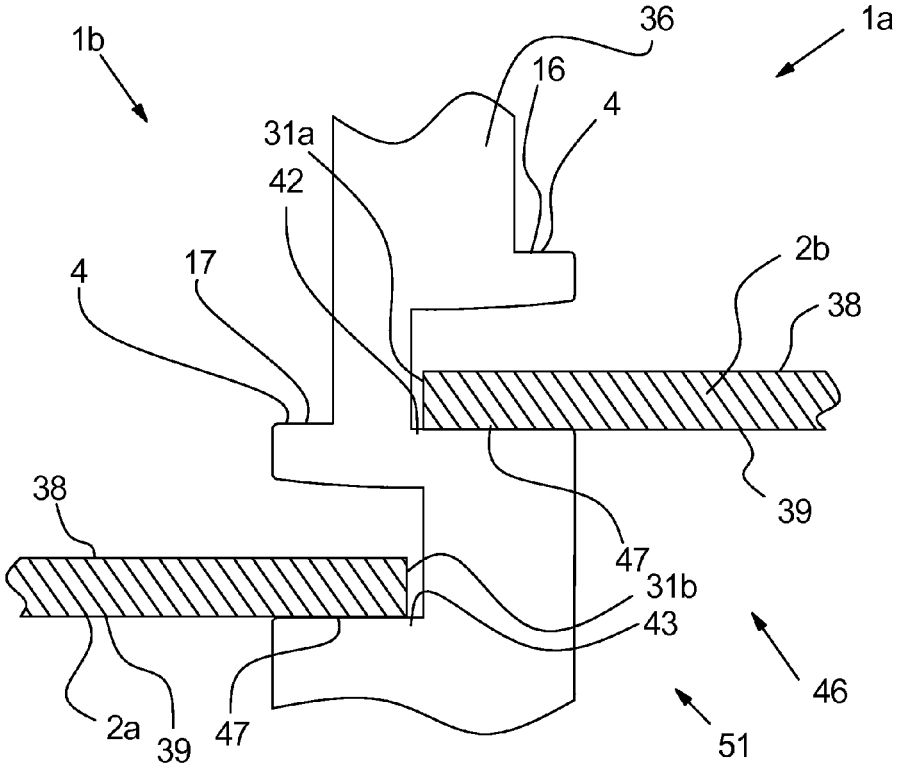
FIG. 2 illustrates the rear part of a rail arrangement according to a preferred embodiment of the invention, seen from the rear end of the rail arrangement.

FIG. 2 illustrates a rail arrangement 51 of the rail system 1 comprising both a right rail arrangement 1*a* and left rail arrangement 1*b* guiding each their side 31*a*, 31*b* of the lids 2*a*, 2*b*. The figure illustrates the rear part 46 of such a rail arrangement 51 seen from the rear end. In FIG. 2, the lids 2 are opened and are released from the vertical displaced guiding paths 16, 17, and are guided by lid-guiding surfaces 42, 43. Due to that the vertical displaced guiding paths 16, 17 are arranged at least partly above each other, and that the rear part 9 of the lid 2*a*, 2*b* is arranged hanging from the second track 4 by means of the upper contact part 48 so that the sides 31*a*, 31*b* of the lids 2*a*, 2*b* extend in under the rail arrangement 51 comprising the second tracks 4, it is possible to arrange the sides of the lids 2*a*, 2*b* close together. Furthermore, it facilitates that the rear part of the rail arrangement 51 does not support on the bottom of the storage compartment 22, but can instead hang from an upper stationary part 19 of the storage unit 20.

Figure 3:
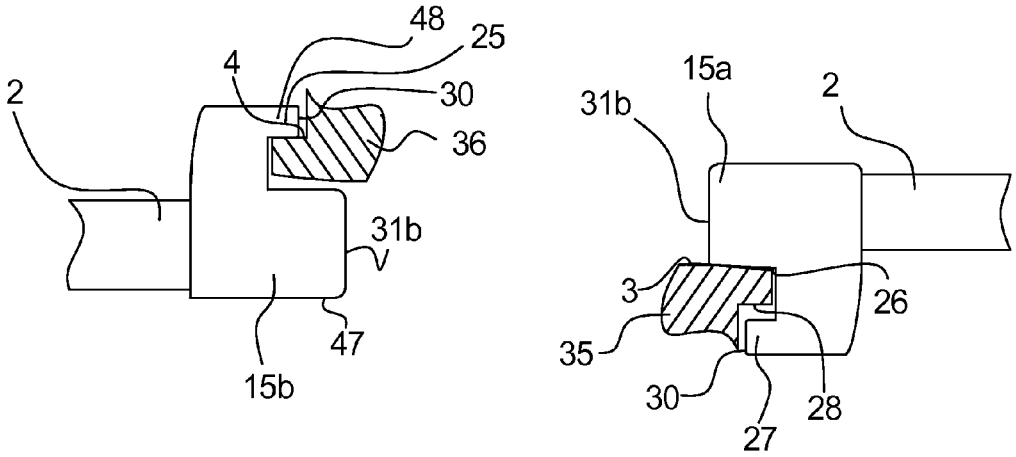
FIG. 3 illustrates a front connection part according to embodiments of the invention, where a lid of the cover is seen from the front, and a rear connection part where the lid of the cover is seen from the rear.

FIG. 3 illustrates a front connection part 15*a* arranged at the right side of a lid 2 seen from the front. Likewise, FIG. 3 illustrates a rear connection part 15*b* arranged at the right side of a lid 2 seen from the rear of the lid. As illustrated, the lid 2*a* hangs from the upper contact part 48 of the lid 2 and extends in under the rail 36 comprising the second track 4. This is facilitated by that the sides of the outer end 30 of the upper contact part 48 is located above the lid 2 so that the sides 31*a*, 31*b* of the lid 2 extends beyond the outer end 30 of the upper contact part 48.

The front connection part 15*a* as illustrated comprises the lower contact part 27 for holding the front part 10 of the lid 2 when the rear part 9 of the lid 2 has been released from the second track 4 to prevent unintentional pivoting of the lid 2.

It is in general understood that connection parts 25 for guiding the lid may be considered as a part of the lid(s) of the cover 1.

Preferably, one or more of the contact parts 25, such as the upper contact part 48 at the rear part 9 of the lid 2 and the lower contact part 27 at the front part 10 of the lid 2 extends horizontally from the lid 2 as illustrated, but they may also extend in an angle in relation to horizontal (not illustrated). This may e.g. be advantageous if the on or more of the tracks are also arranged in an angle in relation to horizontal (not illustrated) in relation to the longitudinal direction of the tracks 3, 4, 28.

FIGS. 4-9 illustrate the operation from a closed to an open position of two lids 2*a*, 2*b* arranged next to each other.

Figure 4:
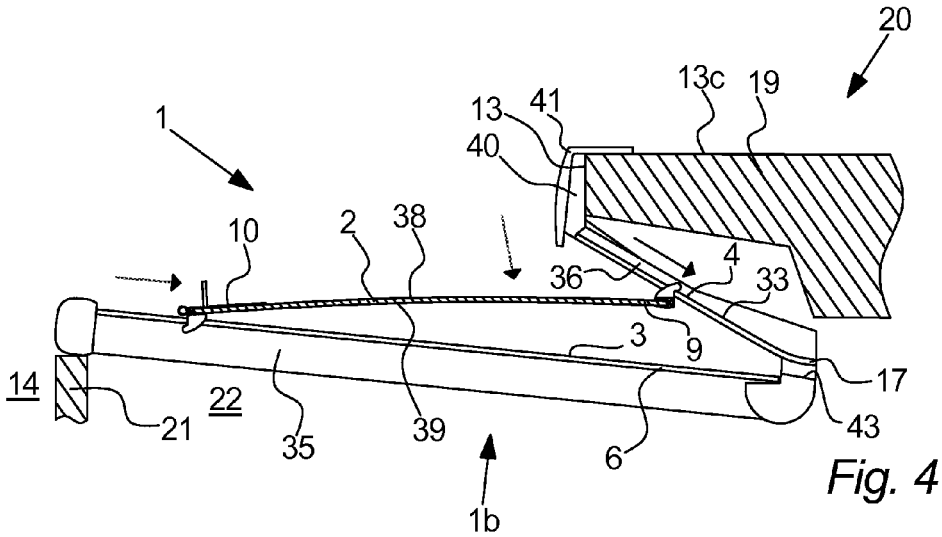
FIG. 4 illustrates an embodiment of the invention where the lid is partly opened.
Figure 5:
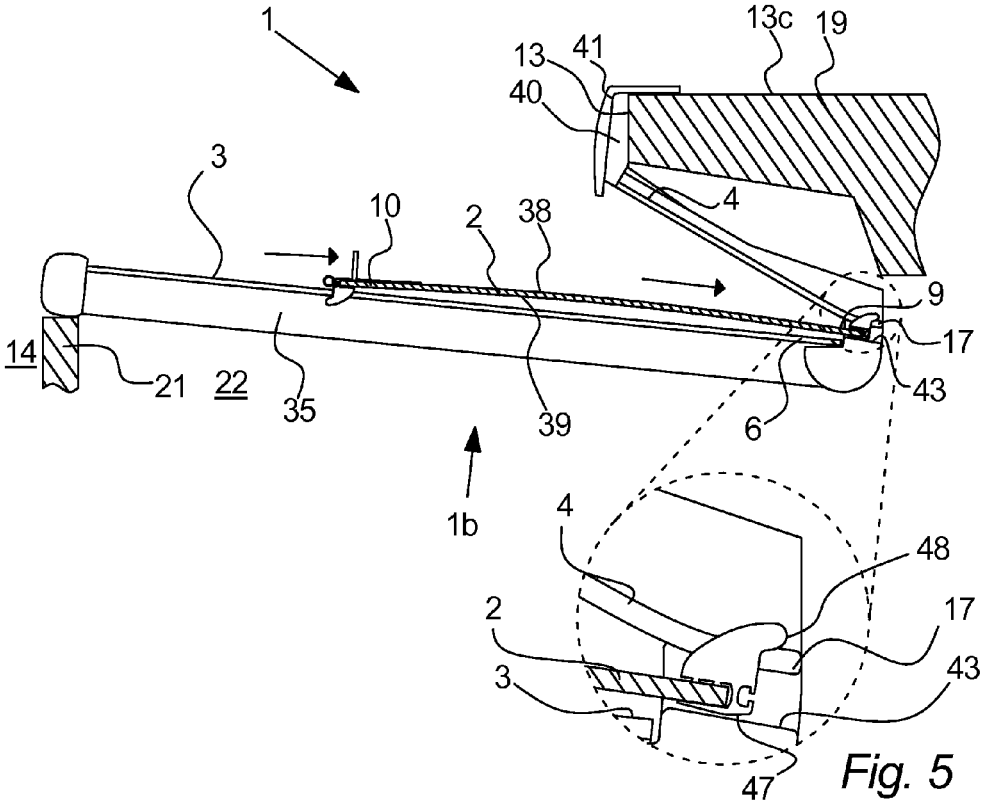
FIG. 5 illustrates an embodiment of the invention where a lid is partly opened, and the rear part of the lid has reached the rear of a second track at a lower guiding path.

In FIG. 4, a first lid 2*a* is opened and as illustrated, the rear part 9 of the lid 2 is displaced to a lower position due to the mutual angle a2 between the first track 3 and the second track 4. In FIG. 5, the rear part 9 of the lid 2 has reached the lower vertical displaced guiding path 17, and is about to be released from the rear part of the second track 4. In FIG. 5, only the lower guiding path 17 of the rail is shown, to ease understanding of the figure.

Figure 6:
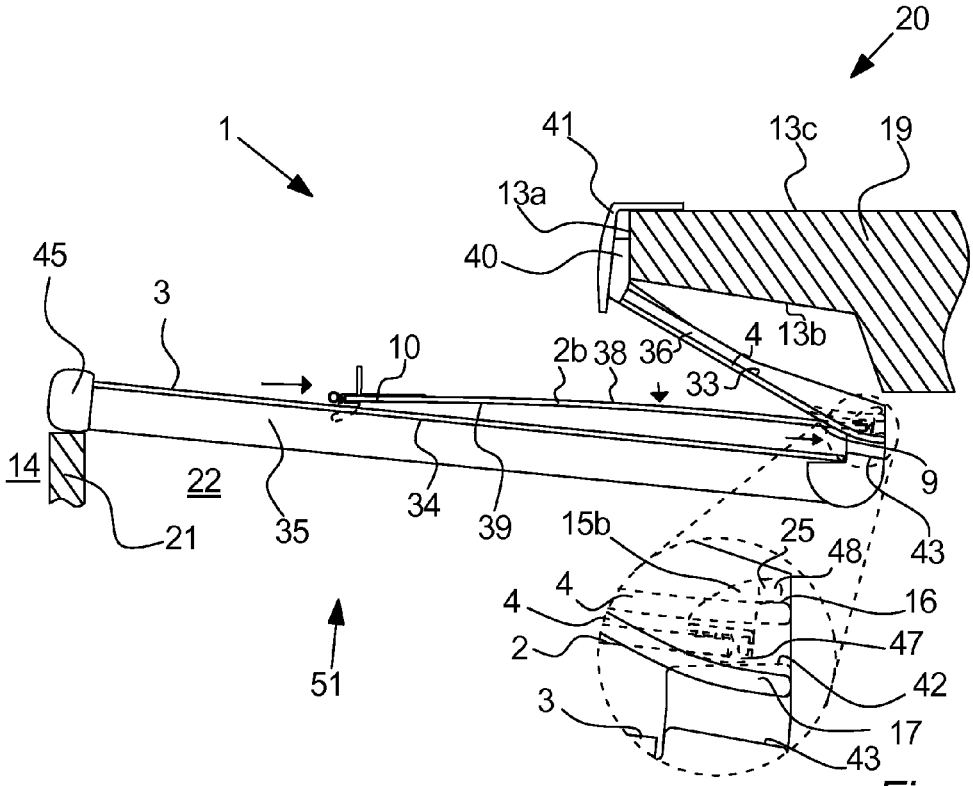
FIG. 6 illustrates an embodiment of the invention where a lid is partly opened, and the rear part of the lid has reached the rear of a second track at an upper guiding path.

FIG. 6 illustrates a second lid 2*b* which is arranged next to the lid of FIG. 5, and is arranged to follow the upper vertical guiding path 16 which is illustrated by the dashed lines at the rear of the lid 2*a*. In this figure, the first lid 2*a* is not shown.

Figure 7:
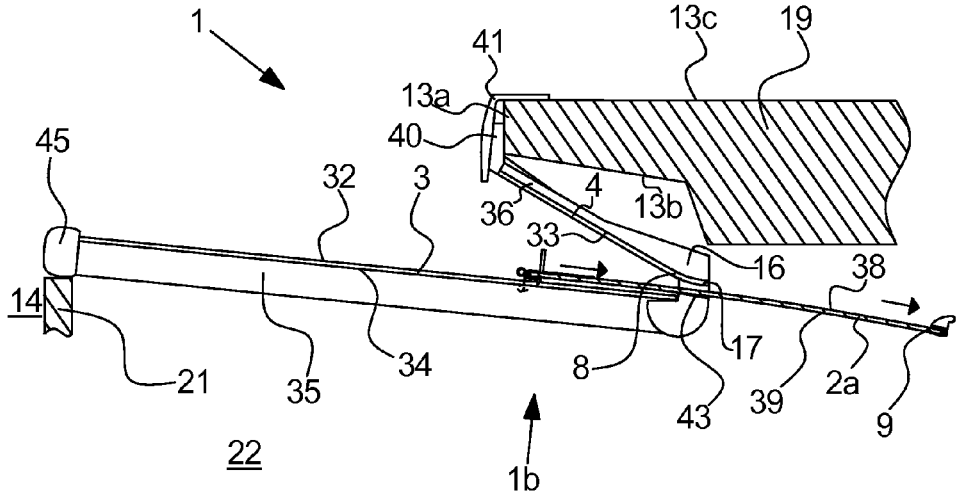
FIG. 7 illustrates an embodiment of the invention where a lid is fully opened.

FIG. 7 illustrates an open lid, where the rear part 9 of the first lid 2*a* has been released from the second track 4 at the lower guiding path 17 and is supported by the lower lid-guiding surface 43 and the lower contact part 27 of the front connection part 15*a* of the first lid 2*a* supports on the third track 28.

Figure 8:
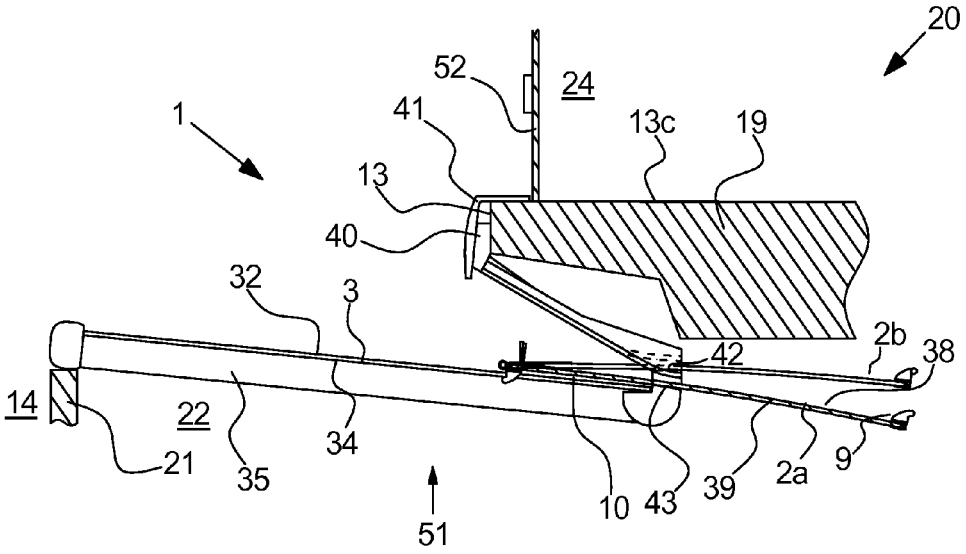
FIG. 8 illustrates an embodiment of the invention where two lids arranged next to each other, and where the rear part of the lids are vertically displaced in relation to each other by means of vertical displaced guiding paths and/or upper/lower lid guiding surfaces.

FIG. 8 illustrates the two lids 2*a*, 2*b* arranged next to each other, where the covers are arranged in a substantially fully open position. As illustrated, the rear part 9 of the lids 2*a*, 2*b* are released from the vertically displaced guiding paths 16, 17, and the rear 9 of the lids 2*a*, 2*b* are vertically displaced in relation to each other. The fully open position may e.g. be where the rear of the lid reaches the rear of the storage compartment, or where the front connection part 15*a* reaches the rear of the rail arrangement 46, thereby preventing further opening of the lid.

FIG. 8 further illustrates a storage unit 20 comprising both a lower storage compartment 22 (as e.g. a chest freezer) and an upper, upright storage compartment 24 above the lower storage compartment 22. The lower storage compartment 22 is accessible trough a substantial horizontal plane, whereas the upper storage compartment 24 is accessible trough a substantial vertical plane. Both storage compartments 22, 24 are preferably accessible from the access side 14 of the storage unit 20.

It is understood that the storage compartments 22, 24 may be a part of the same storage unit 20. Likewise, the storage compartments 22, 24 may be a part of two different storage units, where the storage unit comprising the upper storage compartment 24 is placed on the storage unit comprising the lower storage compartment. In the latter case, the storage units comprising each their storage compartments 22, 24 may be regarded at as one storage unit.

Figure 9:
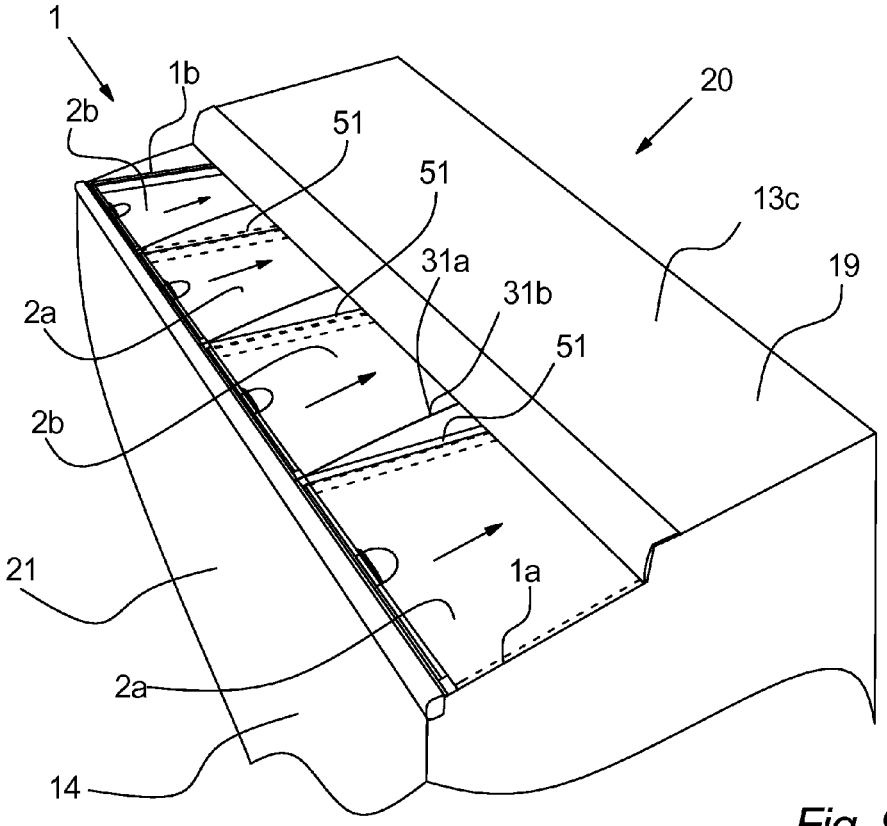
FIG. 9 illustrates an embodiment of the invention where a merchandising storage unit comprises a plurality of lids arranged next to each other.

FIG. 9 illustrates a storage unit 20 with a cover 1 according to the invention, where the cover comprises a plurality of lids 2*a*, 2*b* arranged next to each other as explained in relation to FIGS. 4-8. The upper stationary part 19 of the storage unit 20 may be used as a shelf/table, e.g. for storing and presenting of goods (not illustrated), and the cooling furniture in this embodiment does not comprise an upper storage compartment 24. However, the upper stationary part 19 may also be utilized for supporting a further cooling furniture with a further storage compartment 24.

Figure 10:
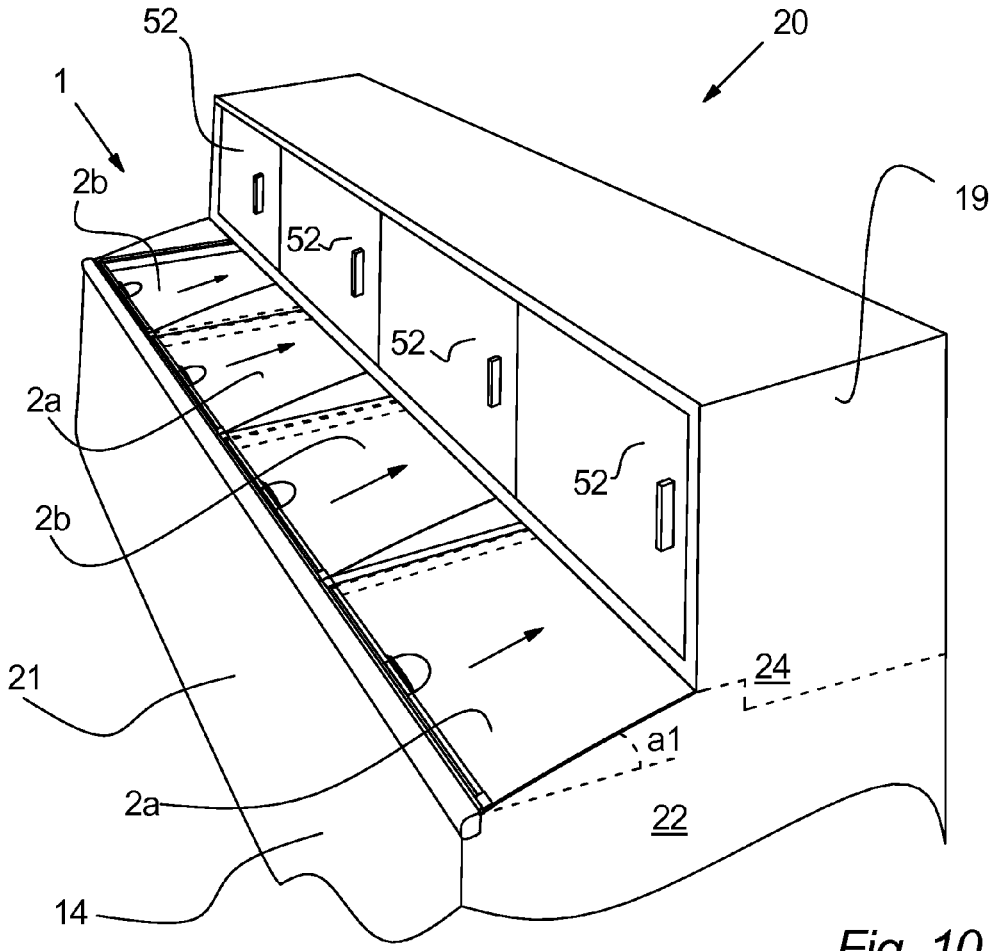
FIG. 10 illustrates an embodiment of the invention where a merchandising storage unit comprises a plurality of lids arranged next to each other and a further upper storage compartment.

FIG. 10 illustrates a cooling furniture 20 comprising both a lower rectangular storage compartment 22, and an upper storage compartment 24, as mentioned above. The upper storage compartment comprises four vertical doors 52, which may be operated to gain access to the upper storage compartment 24.

Figure 11:
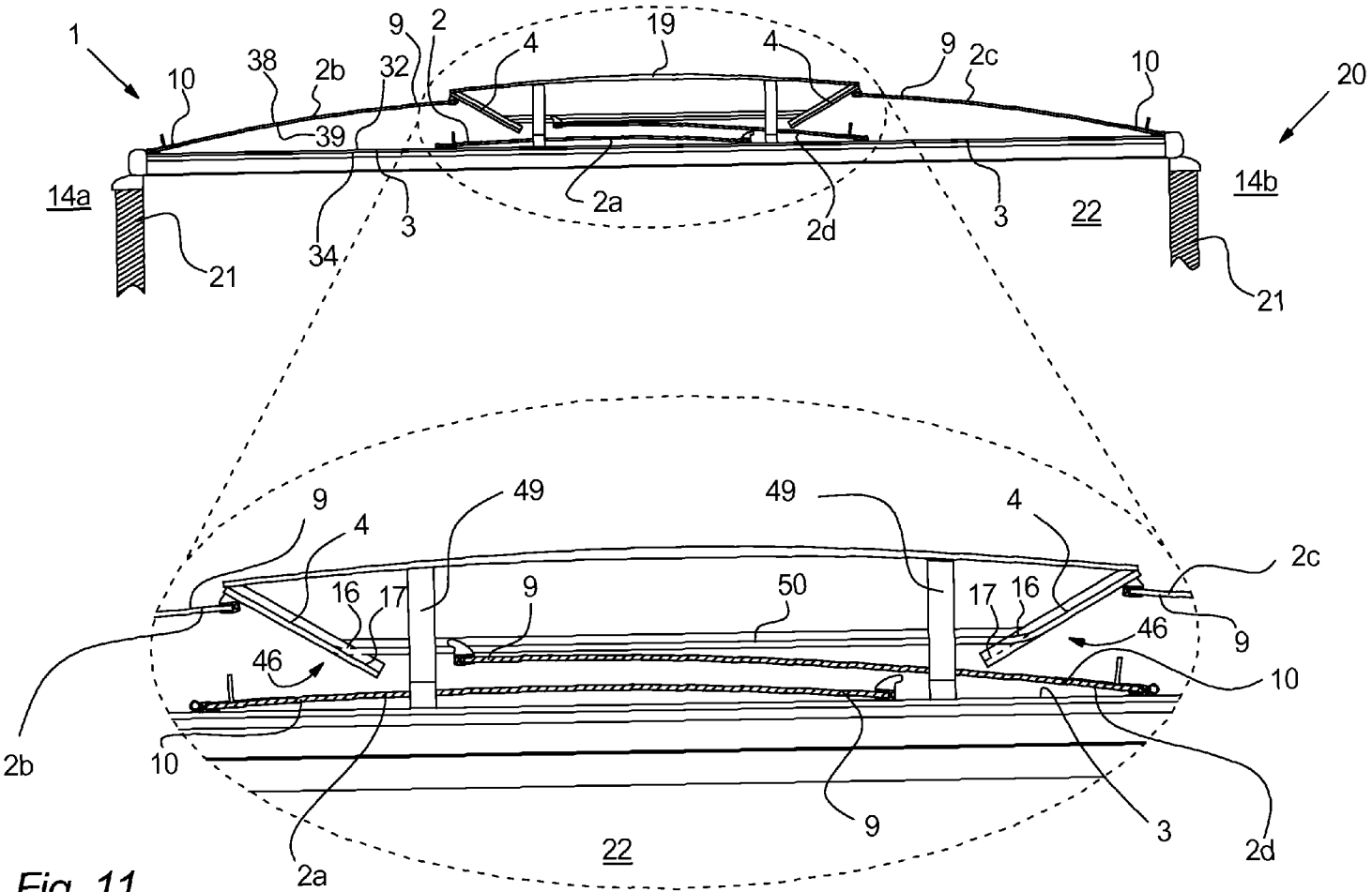
FIG. 11 illustrates an embodiment of the invention where the cover comprises both lids arranged next to each other and opposite to each other.

FIG. 11 illustrates the cover 1 of a storage unit 20, where the cover comprises a first pair of lids, namely a first lid 2*a*, and a second lid 2*b* arranged next to each other. Furthermore, the cover 1 comprises a second pair of lids, namely a third lid 2*c*, and a fourth lid 2*d* arranged next to each other and opposite to the first pair of lids 2*a*, 2*b*. The first lid 2*a* and the fourth lid 2*d* are arranged opposite to each other, and the second lid 2*b* and the third lid 2*c* are arranged opposite to each other. In a closed position, the lids 2*a*, 2*b*, 2*c*, 2*d* are arranged in an angle a1 (not shown in FIG. 11) in relation to horizontal.

It is in general understood that the cover 1 may comprise a plurality of lids arranged side by side and/or opposite to each other.

The rail arrangements 1*a*, 1*b* in this embodiment comprises a further upper track 50 for guiding the rear part 9 of the lids 2*d* and 2*b*. The further upper track may be considered as a part of the second track 4 when utilizing the upper guiding path 16. In FIG. 11, the lid 2*a* is arranged right to the lid 2*b* seen from the access side 14*a* of the lids 2*a*, 2*b*, and the lid 2*c* is arranged right to the lid 2*d*, seen from the access side 14*b* of the lids 2*c*, 2*d*. The front parts 10 of the lids 2*a*, 2*b*, 2*c*, 2*d* are guided by a first track 3, whereas the rear parts 9 of the lids are divided to be guided by an upper vertical displaced guiding path 16 and a lower vertical displaced guiding path 17 respectively.

In the present example, the rear part 9 of the first lid 2*a* is guided by a lower vertical displaced guiding path 17 and is released from the second track 4 during an opening of the first lid 2*a*. The second lid 2*b* next to the first lid 2*a* on the other hand is when opened guided by the upper guiding path 16 to an upper track 50 above the first track 3.

Furthermore, the rear part 9 of the third lid 2*c* is guided by a lower guiding path 17 of the second track 4, whereas the rear part 9 of the fourth lid 2*d* is guided by the upper guiding path 16 of the second track 4 to the upper track 50 above the first track 3, for guiding the rear part of the lid 2*d*.

Due to that the rear part 9 of the first lid 2*a* is guided by a lower vertical displaced guiding path 17, and that the fourth lid 2*d* opposite to the first lid 2*a* is guided by an upper vertical displaced guiding path 16, the rear parts 9 of the first 2*a* and fourth 2*d* lids are vertically displaces so that the rear part 9 of the lids 2*a*, 2*d* are arranged with a vertical distance in relation to each other. Thereby, the lids 2*a*-2*d* may be fully opened at the same time in a space saving manner, without being in the way for each other.

Furthermore, in this embodiment the upper stationary part 19 comprises one or more support parts 49 for supporting the upper stationary part 19. The rear part of the rail arrangements 1*a*, 1*b* may be attached to these support parts 49, or at other locations of the upper stationary part 19 of the cooling furniture 20, or the like.

It should be noted that the above way of guiding the rear parts 9 of the lids 2*a*-2*c* by means of the first track 3 and the upper track 50 may be substituted by the guiding of the rear parts 9 which are illustrated and explained in relation to FIG. 1, and FIGS. 4-8. Likewise it should be understood that the above way of guiding the rear parts 9 of the lids 2*a*-2*c* by means of the first track and the upper track 50 may be substituted into any of the examples of FIG. 1, and FIGS. 4-8.

In general it is to be understood that the invention is not limited to the particular examples described above but may be designed in a multitude of varieties within the scope of the invention, as specified in the claims.

The invention claimed is:

1. A cover for a merchandising storage unit for displaying of goods, the storage unit having a storage compartment, said cover comprising at least two lids, each having a rear part and a front part, and each of which is adapted to be displaceable towards an open position by displacing the lid away from an access side of the storage compartment when the cover is installed at the storage unit, wherein each lid in a closed position is adapted to be arranged at an angle in relation to horizontal, the cover having a rail system having at least two right rail arrangements and two left rail arrangements for independent guiding of the at least two lids arranged next to each other, where each rail arrangement comprises:

a first track for guiding the front part of the lid and having a front part and a rear part, and a second track for guiding the rear part of the lid and having a front part, and a rear part, wherein said second track is separate to said first track, where at least one of said right rail arrangements and at least one of said left rail arrangements are arranged together at one rail arrangement for guiding the at least two lids, wherein the rear part of the lid(s) are configured to hang from the second track by means of an upper contact part, and wherein a side of the lid extends over an outer end of the upper contact part, so that the side of the lid extends in under the rail comprising the second track, wherein said rail system comprising at least two right rail arrangements and at least two left rail arrangements comprises two second tracks with vertical displaced guiding paths arranged above each other for guiding the rear of the at least two lids when the lids are partly displaced towards the open position.

2. The cover according to claim 1, wherein, for each rail arrangement, the front part of the second track is arranged above the first track so that the rear part of the lid at least in a closed position is elevated with a distance from the first track.

3. The cover according to claim 1, wherein, for each rail arrangement, the front part of the lid is rotatably connected to the first track around a substantial horizontal axis, and wherein the front part of the second track is arranged at a larger vertical distance from the first track than the rear part of the second track, so that the tracks are arranged with a mutual angle, and so that the lid will rotate around at least one horizontal axis when displaced from the closed position towards the open position.

4. The cover according to claim 1, wherein, for each rail arrangement, the first track is arranged in a first rail, and wherein the second track is arranged in a second rail.

5. The cover according to claim 1, wherein the rear part of the rail arrangements is adapted to be attached to and hangs from an upper stationary part of the storage unit when the cover is installed at the storage unit.

6. The cover according to claim 1, wherein, for each rail arrangement, the rear part of the lid during an opening of the lid is configured to be released from the rear part of the second track, and wherein the rear part of the lid during closing of the lid is configured to connect to and be guided by the second track when it reaches the second track.

7. The cover according to claim 1, wherein, for each rail arrangement, the rear part of the lid comprises an upper contact part arranged above the upper surface of the lid which is arranged to connect the lid to the second track.

8. The cover according to claim 1, wherein, for each rail arrangement, the front part of the lid comprises a lower contact part, and wherein the lower contact part is configured to support on a third track with a contact surface below and opposite to the first track, thereby preventing pivoting of the lid when the lid has been released from the second track and/or preventing users from disassembling the cover.

9. The cover according to claim 1, wherein a horizontal distance between sides of the lids arranged next to each other is less than 10 mm.

10. The cover according to claim 9, wherein the horizontal distance between the sides of the lids arranged next to each other is less than 5 mm.

11. The cover according to claim 1, comprising two rail system rows with oppositely directed opening directions, and wherein the rear part of lids arranged opposite to each other are configured to be vertically displaced in relation to each other so that access to the storage compartment by means of the oppositely arranged lids is possible independently from each access side.

12. A merchandising storage unit having a rectangular storage compartment and a cover according to claim 11.

13. The cover according to claim 1, wherein the rear part of the lids are vertically displaced by means of vertically displaced guiding paths of the second rails for guiding the rear part of the lids during an opening of the lid.

14. A method of retrofitting the cover according to claim 1 on the merchandising storage unit for display of goods said method comprising:

attaching a front support of the cover to a front side of the storage unit, and attaching a rear part of the cover to an upper stationary part of the storage unit.

15. A merchandising storage unit comprising a lower storage compartment and an upper stationary part, wherein the storage unit comprises a cover according to claim 1, and wherein the lids of the cover are displaced to a position underneath the upper stationary part during an opening of a lids.

16. The merchandising storage unit according to claim 15, wherein the upper stationary part comprises an upper storage compartment.

17. A cover for a merchandising storage unit for displaying of goods, the storage unit having a storage compartment, said cover comprising at least two lids each having a rear part and a front part, and each of which is adapted to be displaceable towards an open position by displacing the lids away from an access side of the storage compartment when the cover is installed at the storage unit, the cover having a rail system having at least a right rail arrangement and a left rail arrangement for guiding each lid, wherein each rail arrangement comprises:

a first track for guiding the front part of a lid and having a front part and a rear part, and a second track for guiding the rear part of a lid and having a front part, and a rear part, wherein at least the rear part of the at least two lids arranged opposite to each other are configured to be vertically displaced in relation each other during opening so that access to the storage compartment by means of the oppositely arranged lids is facilitated independently from each access side when the cover is installed at the storage unit.

18. A merchandising storage unit comprising a cover according to claim 17.

* * * * *